US006065400A

United States Patent [19]

Van Weverberg

[11] Patent Number: 6,065,400

[45] Date of Patent: May 23, 2000

[54] METHOD FOR MONITORING REGISTRATION OF IMAGES PRINTED BY A PRINTER

[75] Inventor: Erik Gabriel Geradus Van Weverberg, Morstel, Belgium

[73] Assignee: Xeikon N.V., Mortsel, Belgium

[21] Appl. No.: 09/170,563

[22] Filed: Oct. 13, 1998

[30] Foreign Application Priority Data

Oct. 14, 1997 [EP] European Pat. Off. ..... 9738151

[51] Int. Cl.[7] ..... B41F 5/06; B41F 13/02; B65H 23/04

[52] U.S. Cl. ..... 101/181; 101/211; 101/228; 101/485; 101/DIG. 46

[58] Field of Search ..... 101/181, 211, 101/483, 484, 485, 486, 365, 228, 232, DIG. 46; 250/559.01, 559.04, 559.05, 559.06, 559.07, 559.08, 559.2, 559.3, 559.39, 559.44

[56] References Cited

U.S. PATENT DOCUMENTS 4,534,288 8/1985 Brovman ..... 101/211
5,402,726 4/1995 Levien ..... 101/481
5,515,136 5/1996 Nishio et al. ..... 355/37

FOREIGN PATENT DOCUMENTS 0744669 11/1996 European Pat. Off. .

*Primary Examiner*—Kimberly Asher
*Attorney, Agent, or Firm*—Baker Botts L.L.P.

[57] ABSTRACT

The printer has at least two printing stations which cause images to be printed on a substrate. The printer is capable of registration adjustment. First and second patterns of spaced registration marks are printed onto the substrate by operation of the printing stations. The second pattern partially overlaps the first pattern to form a composite pattern of registration marks. The composite pattern is illuminated and the reflectivity thereof is examined at wavelengths complementary to the colors of the first and second patterns to obtain a reflectivity signature for the composite pattern. The reflectivity signature of the composite pattern (120) is compared with a predetermined signature to determine an adjustment factor for the printer.

10 Claims, 4 Drawing Sheets

METHOD FOR MONITORING REGISTRATION OF IMAGES PRINTED BY A PRINTER

FIELD OF THE INVENTION

The present invention relates to a method for monitoring registration of images printed by a printer, in particular a multi-color printer of the type in which at least two printing stations cause different images to be printed on a substrate.

BACKGROUND OF THE INVENTION

Methods are known for monitoring registration of images printed by a printer of the type in which at least two printing stations cause different images to be printed on a substrate, the printer being capable of registration adjustment. According to this method a first pattern of registration marks of a first color is printed onto the substrate by operation of one of the printing stations. A second pattern of registration marks of a second color is printed onto the substrate by operation of another printing station. The second pattern partially overlaps the first pattern to form a composite pattern of registration marks. The composite pattern is illuminated and the reflectivity thereof is examined to obtain a reflectivity signature for the composite pattern. The reflectivity signature of the composite pattern is compared with a predetermined signature to determine an adjustment factor for the printer.

In U.S. Pat. No. 5,402,726 (Levien) a register pattern and a system for bringing a pair of register patterns into alignment is disclosed. A first pattern comprises a plurality of dots of a first frequency, while a second pattern comprises a plurality of dots of a second frequency. When the patterns are overlaid, an interference pattern is observed. Images are in correct register when the interference pattern produces a maximum bright region in the center of the overlaid pattern. The position of the bright region is detected for example by the use of an on-line sensor of photosensitive elements. A small relative movement of the images out of register produces a relatively large movement in the position of the bright region. The position of the bright region indicates the direction and degree of correction required for correct registration.

The arrangement disclosed by Levien suffers from the disadvantage that a large number of dots have to be printed and measured in order to determine the position of the bright region and that it is necessary to calibrate an array of photosensitive elements. The Levien arrangement also requires a high measurement resolution in order to measure all of the composite pattern.

European patent application EP 0744669 (Xerox Corporation) discloses a wide area beam sensing method and apparatus for image registration calibration in a color printer. The method includes printing a first pattern of spaced registration marks in a first color onto a black or transparent image bearing member, printing a second pattern of spaced registration marks in black onto the image bearing member to partially overlap and mask the first pattern, illuminating the composite pattern so formed to produce actual diffuse and direct light reflectance measurement values from the printed marks and comparing the measurement values to obtain an adjustment factor for the printer.

This method suffers from the disadvantage that measurements have to be taken on a black or transparent image bearing surface, which is typically a transfer belt in the printer, whereas it is preferable to take measurements on the final image bearing substrate, typically paper, which is white or colored but almost certainly not black or transparent. Furthermore, it is preferable that measurements be taken after the toner image has been fixed to the substrate, whereas the method of EP 0744669 is essentially carried out prior to fixing the image. This is because the glossy effect of the fixed black toner will otherwise not have the necessary masking effect while fixing of a multicolor image results in some mixing of the different color toners resulting in an image density which may be different from that of the un-fixed image. Still further, the method of EP 744669 does not enable control of registration of two images printed in the same color, for example black on black, which may sometimes be required. Yet further, the method of EP 744669 does not enable control of registration of two images both printed in a color other than black or, for example, where "black" images are obtained by a superposition of images of three or more other colors.

OBJECTS OF THE INVENTION

It is an object of the present invention to provide a method for monitoring registration of images printed by a multi-station printer in which a minimum number of registration marks need be printed and where the method is capable of monitoring the registration of two images printed in the same color, in colors other than black and/or where "black" images are obtained by a superposition of images of three or more other colors.

SUMMARY OF THE INVENTION

We have discovered that this objective, and other useful benefits, can be obtained when the reflectivity of the composite pattern is measured at wavelengths complementary to the colors of the first and second patterns.

Thus, according to the invention, there is provided a method for monitoring registration of images printed by a printer of the type in which at least two printing stations cause images to be printed on a substrate, the printer being capable of registration adjustment, the method comprising:

(a) printing a first pattern of spaced registration marks onto the substrate by operation of one of the printing stations;

(b) printing a second pattern of spaced registration marks onto the substrate by operation of another of the printing stations, the second pattern partially overlapping the first pattern to form a composite pattern of registration marks with interposed spaces;

(c) illuminating the composite pattern and examining the reflectivity thereof to obtain a reflectivity signature for the composite pattern; and (d) comparing the reflectivity signature of the composite pattern with a predetermined signature, indicative of good registration, to determine an adjustment factor for the printer, characterized in that the reflectivity of the composite pattern is examined at wavelengths complementary to the colors of the first and second patterns.

The method may further comprise applying the adjustment factor to the printer to ensure correct registration of subsequently printed images.

Preferably, the first pattern of spaced registration marks comprises a first sequence of first marks having a known spacial distribution and the second pattern of spaced registration marks comprises a second sequence of second marks having a spacial distribution different from that of the first sequence. The first pattern of registration marks may comprise a sequence of groups of first marks and the second pattern of registration marks may comprise a sequence of groups of second marks, the first sequence having a spacing different from that of the second spacing. In one embodiment the difference between the spacing of the groups in the first sequence and the spacing of the groups in the second sequence corresponds to the minimum possible registration adjustment which can be applied to the printer. Preferably the closest spacing of the marks in any sequence or group is not less than the width of the marks in the same measurement direction.

The predetermined reflectivity signature may include a point of minimum reflectivity and the measured reflectivity signature may include a point of minimum reflectivity, offset from the position of the predetermined reflectivity signature minimum by a distance indicative of the adjustment factor. In an alternative embodiment, the signatures include points of maximum reflectivity.

The patterns can be located close to the edge of the printed substrate, which position usually represents the empty margin of the image being printed, or between two successive print pages.

In a preferred embodiment, one of the printing stations is considered as a reference station requiring no adjustment, whereby the adjustment factor is indicative of an adjustment to be applied to the other of the printing stations.

It is possible for both the first and second patterns to be printed in black, where the printer is of the type in which two or more black images are printed at different printing stations. It is also possible for the first and second patterns to be printed on opposite faces of a transparent substrate. However, it is more usual that a multi-station printer is used for printing images of different colors at the different printing stations. It is therefore a more usual embodiment of the present invention that the first pattern of spaced registration marks is printed in a first color and the second pattern of spaced registration marks is printed in a second color, different from the first color, whereby the composite pattern of registration marks is a multi-color pattern of registration marks.

The multi-color pattern may be illuminated with light from a plurality of light sources, having output wavelengths complementary to the first and second colors. The reflectivity of the multi-color pattern can then be measured by allowing light from the light sources to be reflected by the multi-color pattern to fall on a light sensor. The light sources are preferably light emitting diodes which enable the reflectivity of the multi-color pattern to be measured without the imposition of color filters.

In a preferred embodiment the registration of the various different colored images is considered by taking the colors in pairs. Thus a number of multi-color patterns are printed, each consisting of only two colors. We particularly prefer that the first color is black and the second color is other than black. The advantage of this arrangement is that only one light source is needed for each multi-color pattern, since all visible wavelengths are complimentary to black.

The reflectivity of the composite pattern may be measured off-line by using, for example, a known scanning densitometer comprising a light source and a detector positioned in a fixed relationship to the light source to receive light from the light source reflected by a sample of printed material. The pattern is illuminated with light from the light source and the detector is used to measure the reflected light. Examples of off-line reflectometers include the X-Rite™ 428 Reflection Densitometer, or the DTP51 Desktop Publishing Reflection Colorimeter, both from X-Rite Inc., Michigan, U.S.A.

However, such known devices use light sources of white light and one or more filters are selectively interposed in front of the detector thereby to ensure that only light of a given wavelength band reaches the detector. Complicated optics are required to ensure that the printed substrate is illuminated with parallel light and that the intensity of reflected light reaching the detector is not a function of the distance between the detector and the printed material.

This method is inconvenient in having to remove a sample of printed substrate from the printer and to interpose a selected filter, the light output of most white light sources is unpredictable over time, both in terms of power and wavelength distribution. The known device requires moving parts to enable filters to be changed, or the use of a number of separate detectors. Filters reduce the light reflectivity reaching the detectors, resulting in the need for higher exposure times or more sensitive detectors than would otherwise be the case.

For these various reasons we prefer to use an on-line device where the light source comprises an assembly of light emitting diodes capable, when activated, of emitting light of different wavelength bands.

Such a reflectometer may comprise a light source and a detector positioned in a fixed relationship to the light source to receive light from the light source reflected by the image on a sample of printed material, wherein the light source comprises an assembly of light emitting diodes capable, when activated, of emitting light of different wavelength bands, and control means are included for selectively activating one or more of the light emitting diodes.

Light emitting diodes (LEDs) are readily available, have a short warm-up time, have a longer life and are more reliable in terms of energy and wavelength band output than conventional white light sources. By using light sources of a given wavelength band output, the need for filters is avoided. LEDs are also very low in cost, with the result that the reflectometer can be manufactured for a cost which is orders of magnitude cheaper than conventional devices.

The assembly may comprise at least three LEDs with different output wavelength bands. For example, the assembly comprises at least one blue LED, at least one red LED and at least one green LED. Further LEDs may be present. These may have output wavelengths bands different from the first three LEDs, but little advantage is gained thereby. However, a further LED with an output wavelength band similar to one of the first three LEDs may be advantageous, where the detector is less sensitive to that wavelength band.

In one embodiment, the LEDs and the detector are mounted in a common housing. The mounting of the LED assembly and the detector in a common housing has the advantage that the angle of incidence of light from the LEDs on the printed material lying in the measurement plane, remains constant. This angle is preferably close to 45°, such as from 40° to 50°. The angle of reflection of light from the printed material lying in the measurement plane to the detector is preferably about 90°, such as from 80° to 100°. The housing preferably defines an aperture, behind which the LEDs and the detector are positioned. The smaller the size of the aperture, the smaller need be the size of the patterns or the higher may be the number of readings which can be taken on a given pattern. A smaller aperture, however, requires LEDs of higher output energy, multiple LEDs per wavelength band or a detector of higher sensitivity. As a consequence, smaller test pages can be generated which results in less waste. Also continuous measurements become more cost efficient. In any event, the aperture should be wider than the sum of the width of a registration marks and an adjacent space in the measurement direction.

Since no optics are used, the light intensity detected by the detector depends not only upon the density of the printed substrate but also on the distance thereof from the detector. It is therefore important to position the detector at a fixed distance from the printed substrate. The reflectometer may therefore further comprise means to define a measuring plane in a fixed position relative to the LEDs and the detector. Where the LEDs and the detector are mounted in a common housing, the housing may have surface portions defining the measuring plane. During measurement, these surface portions lie against the printed substrate, thereby ensuring that the distance between the printed substrate and the detector remains constant. The surface portions are preferably formed of a low friction material. This enables the monitoring to be carried out while the printed substrate is moving relative to the reflectometer, without causing damage to the printed substrate. In an alternative embodiment, the housing of the device includes a roller in rolling contact with the substrate close to the measuring position to ensure that the LEDs and the detector remain at a fixed distance from the printed substrate. While it is possible to construct the reflectometer to move in synchronism with the printed substrate, this requires a more complicated construction and control system and is therefore less preferred.

A positioning device may be provided for moving the LEDs and the detector selectively into a measuring position adjacent the sample, and a non-measuring position away from the sample. In this manner, contact between the printed substrate and the reflectometer need only occur when monitoring is taking place. In one embodiment, the positioning device comprise a clamp device having a closed position corresponding to the measuring position and an open position corresponding to the non-measuring position. One arm of the clamp device carries the reflectometer, while the other arm carries a backing plate, which is also preferably coated with a low-friction material. Where the printer is a "duplex" printer, that is a printer which forms images on both faces of the substrate, especially such a printer which uses different sets of print engines for each face, it may be desirable to monitor the reflectivity of images on both faces of the substrate, preferably at the same time, but at locations spaced from one another. Two reflectometers are required in this case. While one reflectometer can act as the backing plate for the other reflectometer, more reliable results are obtained by staggering the two reflectometers. Nevertheless, both reflectometers can be mounted on a common clamp device.

The composite pattern is illuminated with an LED of the complimentary color. A blue LED is used to illuminate a yellow pattern, a red LED is used to illuminate a cyan pattern, and a green LED is used to illuminate a magenta pattern. Any LED color can be used to illuminate a black pattern.

The printed substrate output including the composite pattern may be constrained to a measuring plane while light reflected from the pattern is detected. The output of the detector is processed to generate the adjustment factor and the printer is adjusted when the adjustment factor exceeds a predetermined threshold. This is particularly convenient when the printer is a digital printer. The printer can be adjusted in a number of ways. For example, where the printer uses exposure of a photoconductive surface to generate an initial latent image, the exposure timing can be adjusted.

In order to ensure that the detector is positioned correctly to make the required measurements, a calibration of its position relative to the edge of the substrate is recommended. Means are therefore preferably provided for lateral movement of the device. To ease the location of the reflectometer directly above the composite patterns, where the substrate is in the form of a web, the device may be mounted on a track extending across the web path, with a motor provided to drive the device along the track. This can be particularly beneficial if the printer includes a web alignment compensation system in which variations in web alignment are detected and compensated for by lateral adjustment of the image forming system, or where the printer is to be used for a number of different types of output in which patterns are located in different lateral positions. The means for enabling lateral movement of the device may enable the device to be "parked" in a covered zone away from the web, to facilitate web handling.

Where the printer includes a fixing device for permanently adhering the toner image to the substrate, it will be usual to position the reflectometer downstream of the fixing device, since the latter can have an effect upon the appearance of the toner image.

BRIEF DESCRIPTION OF THE DRAWING

The invention will be described in further detail, purely by way of example, with reference to the accompanying drawings, in which.

DETAILED DESCRIPTION

The printer 26, such as a XEIKON DCP-1 digital printer (ex Xeikon NV, Mortsel, Belgium), includes four image printing stations 102, 104, 106, 108 which cause images of different colors (specifically yellow, magenta, cyan and black) to be printed on a substrate 110 in the form of a web, for example of paper, fed from a supply roll 30. The substrate moves through the printer at a speed of, for example, 12 cm/sec.

Each printing station of the printer is capable of registration adjustment, i.e. adjustment of the positioning and timing of image printing on the web so that each image is adjustable both in the X- and Y-directions.

Figure 2A:
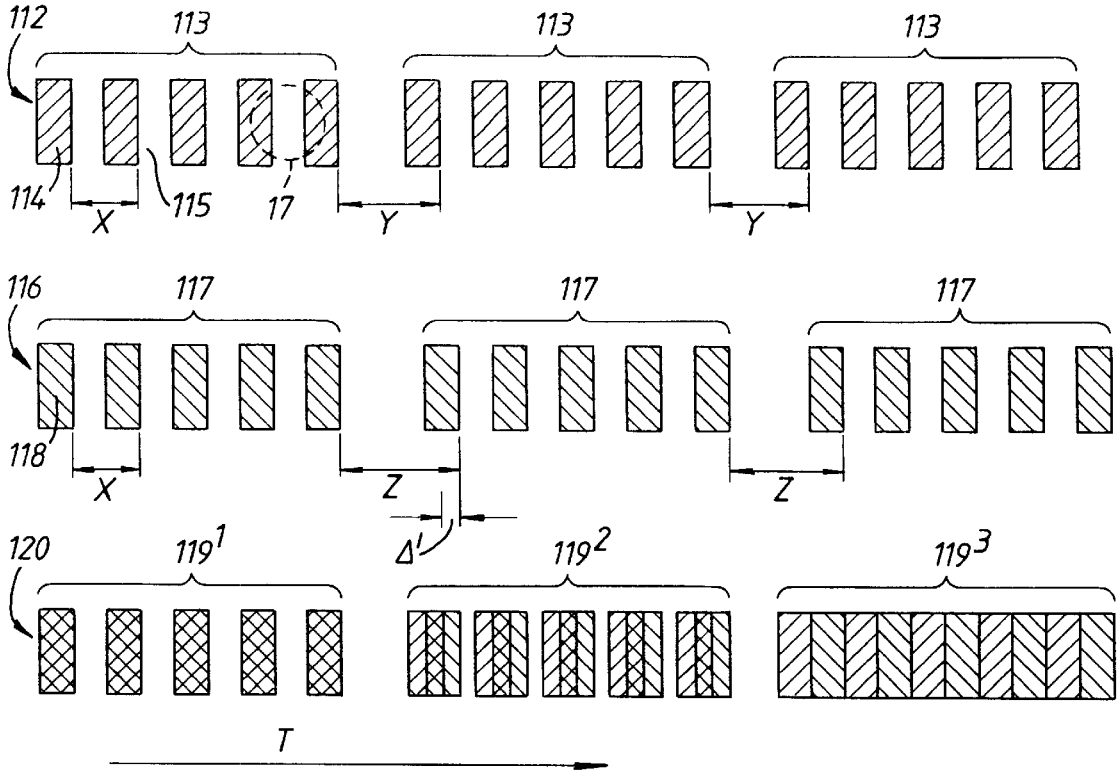
FIG. 2A shows, separately, first and second patterns of register marks used in a method according to the invention for monitoring registration in the transport direction, and a composite overlapping pattern obtained therefrom.

A first pattern 112 of registration marks is printed in black onto the substrate 110 by operation of the black printing station 108. As shown in the top line of FIG. 2A, the first pattern 112 of registration marks comprises a first sequence of equally spaced groups 113 of equally spaced first marks 114. In this case the marks are lines typically having a length of 5.0 mm, a line thickness of 0.25 mm and a spacing of 0.25 mm. Note that in FIG. 2A, the marks are not drawn to scale. FIG. 2A also indicates the size of the sensor aperture 17 in relation to these marks. The sensor aperture 17 is at least as wide as the period of the pattern, that is the total of the width of one mark 114 and its adjacent space 115, but its length is less than the length of the marks 114. The first sequence has a known spacial distribution X, X, X, X, Y, X, X, X, X, etc. Only three groups are shown in FIG. 2A for the sake of clarity, while the preferred number of groups is determined by the preferred detection range. A pattern with nine groups is found to be suitable.

As shown in the second line in FIG. 2A, a second pattern 116 of registration marks is printed onto the substrate 110 in, for example, cyan, by operation of the cyan printing station 106. The second pattern 116 of registration marks comprises a second sequence of equally spaced groups 117 of equally spaced second marks 118. The second sequence has a spacial distribution X, X, X, X, Z, X, X, X, X, etc. different from that of the first sequence. The difference $\Delta^1$ in the transport direction indicated by the arrow T between the spacial distribution of the first sequence and the spacial distribution of the second sequence, i.e. Y–Z, corresponds to the minimum possible registration adjustment which can be applied to the printer.

As shown in the bottom line in FIG. 2A, as printed the second pattern 116 partially overlaps the first pattern 112 to form a multi-color pattern 120 of registration marks. The multi-color pattern has a first group of marks 119$^1$, where the marks 114 from the first pattern 112 exactly overlap marks 118 from the second pattern 116, a second group of marks 119$^2$, where the marks 114 from the first pattern 112 partially overlap marks 118 from the second pattern 116 and a third group of marks 119$^3$, where the marks 114 from the first pattern 112 do not overlap marks 118 from the second pattern 116. The result of this is that the reflectivity of the first group 119$^1$ differs from that of the second and groups 119$^2$, 119$^3$.

Figure 2B:
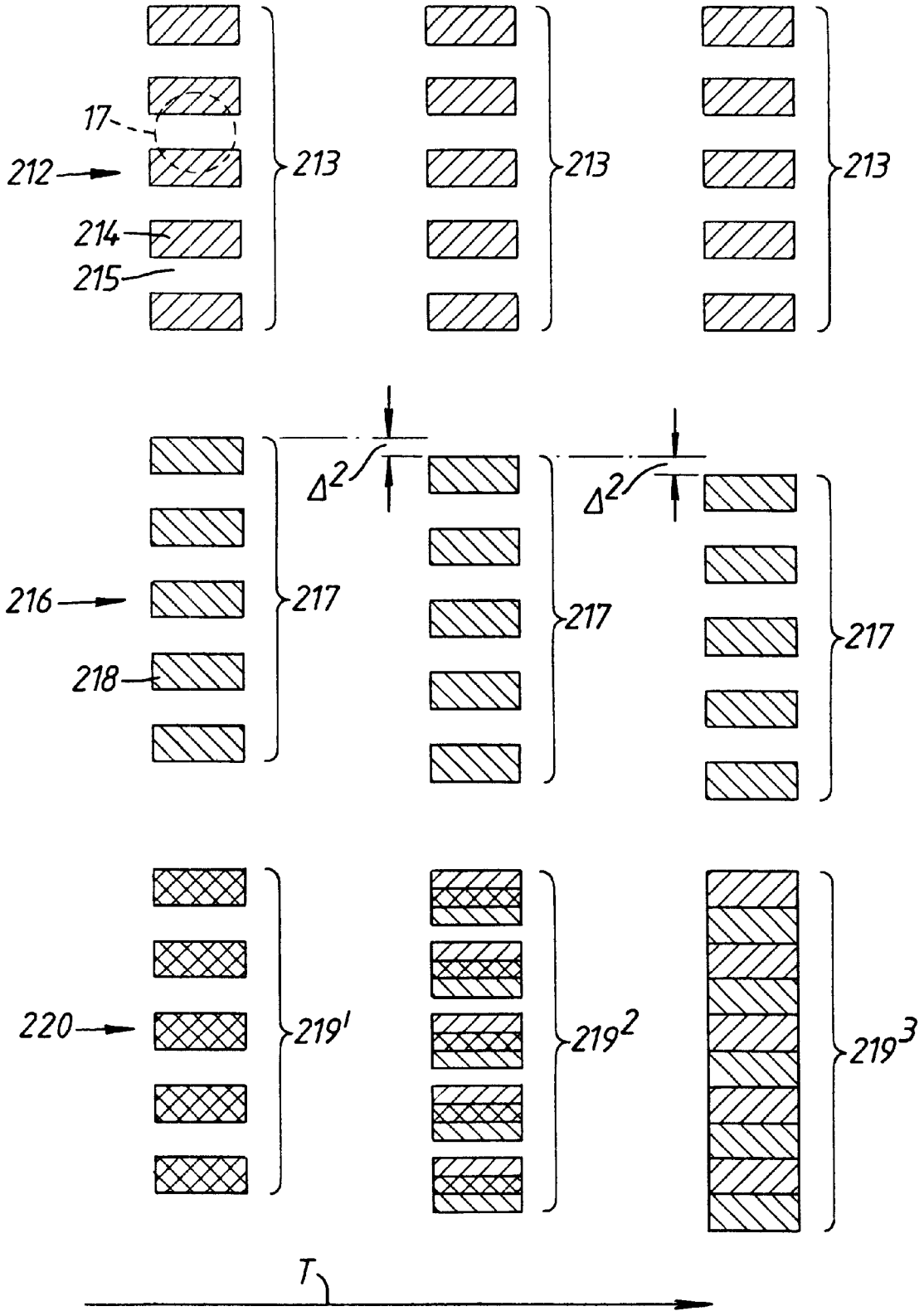
FIG. 2B shows, separately, first and second patterns of register marks used in a method according to the invention for monitoring registration in the cross direction, and a composite overlapping pattern obtained therefrom.

Referring to FIG. 2B, a first pattern 212 of registration marks is printed in black onto the substrate 110 by operation of the black printing station 108. As shown in the top part of FIG. 2B, the first pattern 212 of registration marks comprises a first sequence of groups 213 of equally spaced first marks 214. In this case the marks are lines typically having a length of 5.0 mm, a line thickness of 0.25 mm and a spacing of 0.25 mm. Note that in FIG. 2B, the marks are not drawn to scale. FIG. 2B also indicates the size of the sensor aperture 17 in relation to these marks. The sensor aperture 17 is at least as wide as the period of the pattern, that is the total of the width of one mark 214 and its adjacent space 215, but its length is less than the length of the marks 214.

As shown in the second part of FIG. 2B, a second pattern 216 of registration marks is printed onto the substrate 110 in, for example, cyan, by operation of the cyan printing station 106. The second pattern 216 of registration marks comprises a second sequence of groups 217 of equally spaced second marks 218. The second sequence has a spacial distribution different from that of the first sequence in that each group is offset in the cross direction from the preceding group by $\Delta^2$ which corresponds to the minimum possible registration adjustment which can be applied to the printer.

As shown in the bottom part of FIG. 2B, as printed the second pattern 216 partially overlaps the first pattern 212 to form a multi-color pattern 220 of registration marks. The multi-color pattern has a first group of marks 219$^1$, where the marks 214 from the first pattern 212 exactly overlap marks 218 from the second pattern 216, a second group of marks 219$^2$, where the marks 214 from the first pattern 212 partially overlap marks 218 from the second pattern 216 and a third group of marks 219$^3$, where the marks 214 from the first pattern 212 do not overlap marks 218 from the second pattern 216. The result of this is that the reflectivity of the first group 219$^1$ differs from that of the second and groups 219$^2$, 219$^3$.

Figure 3:
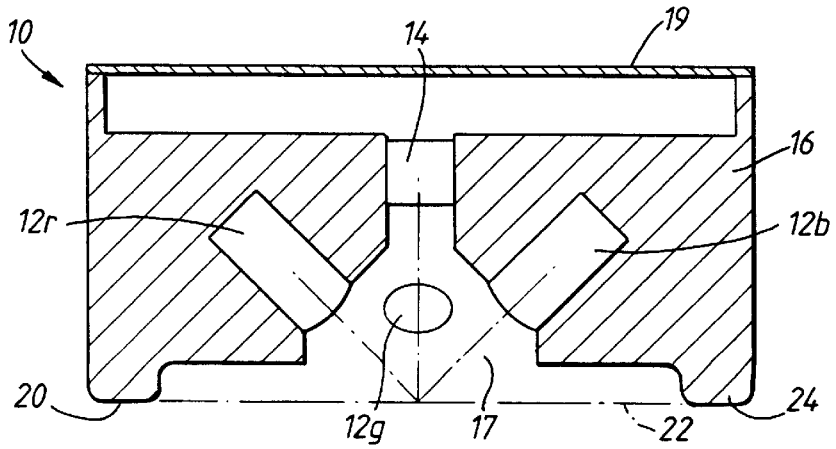
FIG. 3 shows a possible construction for a reflectometer for use in a method according to the invention.

FIG. 3 shows a possible construction of a reflectometer for use in illuminating and detecting the reflectivity of the multi-color pattern 120. The reflectometer 10 comprises a light source which includes an assembly of three light emitting diodes (LEDs) 12*b*, 12*r*, 12*g* with different output wavelength bands, namely a blue LED 12*b*, a red LED 12*r* and a green LED 12*g*. Suitable LEDs are available from SLOAN Precision Optoelectronics, Sloan AG, Basel, Switzerland.

The LED assembly and a detector 14 are mounted in a common housing 16, having a circular aperture 17 of 2 to 3 mm diameter in its lower face. Such an aperture size is suitable for a web speed of about 120 mm/sec, even up to 240 mm/sec. The detector 14 is thus positioned in a fixed relationship to the LEDs 12*b*, 12*r*, 12*g* to receive light from the LEDs reflected by a sample 18 of printed material. Suitable detectors are available from EG&G, UK or HAMAMATSU, Japan. The housing 16 supports a printed circuit board 19, carrying the necessary electronic circuitry, connected in an appropriate manner to the LEDs and the detector. While in the illustrated embodiment, only one LED of each color is used, it may be desirable to use two LEDs of that color to which the detector is least sensitive (usually blue).

The housing 16 has two ski-like extending portions 24, which are orientated parallel to the web transport direction. The surfaces 20 of these ski-like extending portions 24 define a measuring plane 22 in a fixed position relative to the LED assembly and the detector 14. The surfaces 20 are formed of a low friction and long wearing material, for example of PTFE.

The reflectometer is sited in the printer 26 following a radiant image fixing device 36 and a substrate cooling device 38 and in advance of a sheet cutting device 32, from which cut sheets fall into a collection tray 33. The arrangement further includes a control device 34 which is capable of controlling the printer 26 in response to the output of the detector 14.

The multi-color pattern 120 is illuminated with light from the LEDs 12*b*, 12*r*, 12*g*. Specifically, where the multi-color pattern 120 has been printed in magenta, the green LED 12*g* is used. A pattern printed in black may be illuminated with an LED of any color.

The reflectivity of the multi-color pattern 120 is measured by allowing light from the selected LEDs to be reflected by the multi-color pattern 120 to fall on the light sensor 14, without the imposition of color filters. The reflectivity of the multi-color pattern 120 is measured at a resolution larger than the minimum possible registration adjustment which can be applied to the printer.

Figure 4:
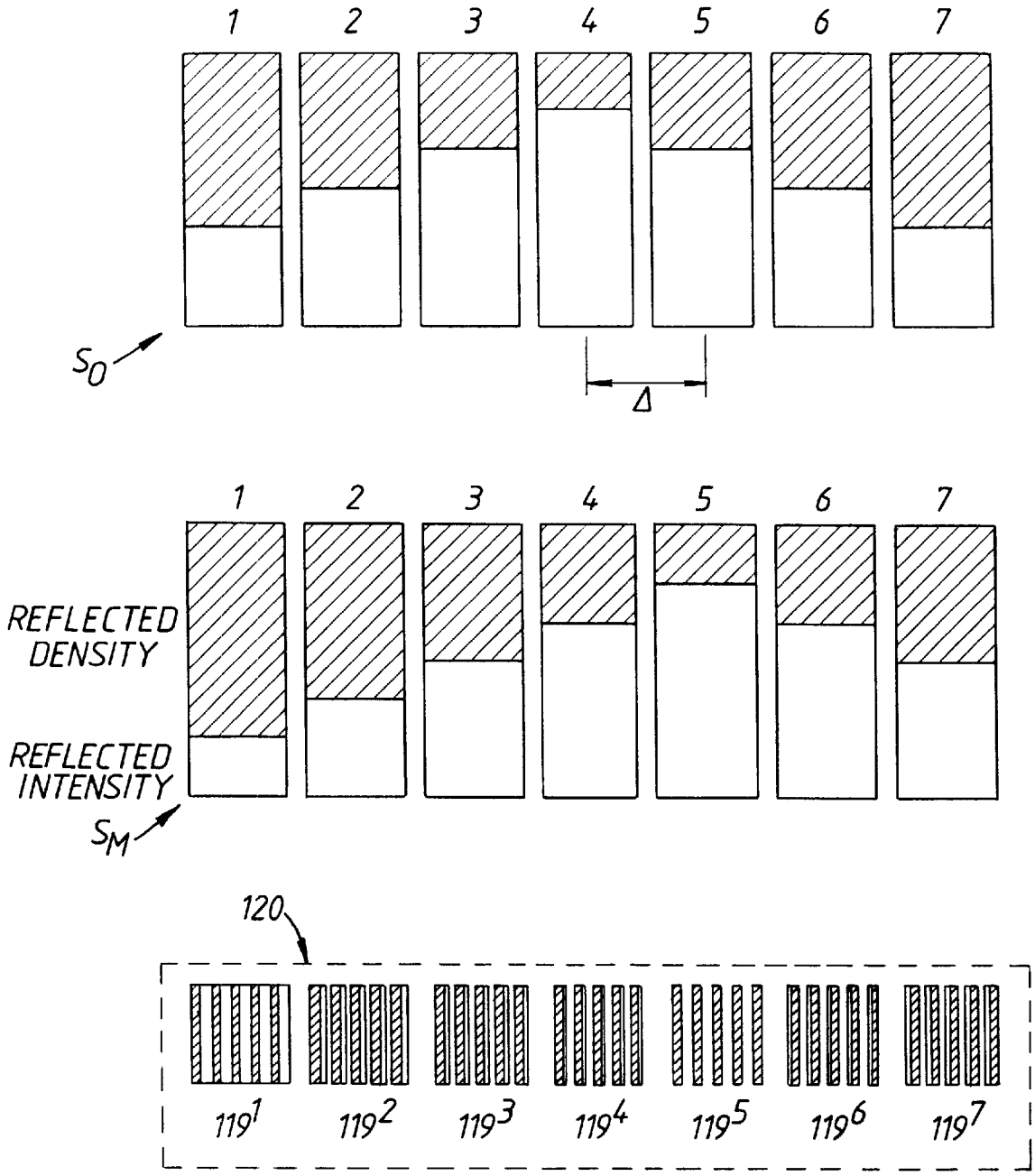
FIG. 4 shows a composite pattern of registration marks, the measured reflectivity signature obtained from such a composite pattern, and a predetermined reflectivity signature representative of good registration.

FIG. 4 shows a composite pattern of registration marks, different from that shown in FIG. 2A. Note that in FIG. 4, the marks are drawn approximately to scale. In this case, the composite pattern 120 is a multi-color pattern formed from patterns printed in black and magenta and comprises seven groups of marks, numbered 119$^1$, 119$^2$, 119$^3$, 119$^4$, 119$^5$, 119$^6$, and 119$^7$. The multi-color pattern 120 is obtained in a manner similar to that described in connection with FIG. 2A, except for the purposes of illustration it is presumed that the composite pattern is obtained under conditions of bad registration between the black and magenta printing stations.

FIG. 4 also shows the measured reflectivity signature $S_M$ obtained from such a composite pattern. It will be seen that in this signature one group, namely Group 5, exhibits a maximum reflectivity. FIG. 4 also shows a predetermined reflectivity signature $S_O$, representative of good registration. In this signature Group 4 is the group having maximum reflectivity. The difference Δ between the maximum reflectivity group number of the measured reflectivity signature $S_M$ and that of the predetermined reflectivity signature $S_O$, in this case a group number difference of 1, is indicative of the an adjustment factor $f_m$ which must be applied to the printer.

Figure 1:
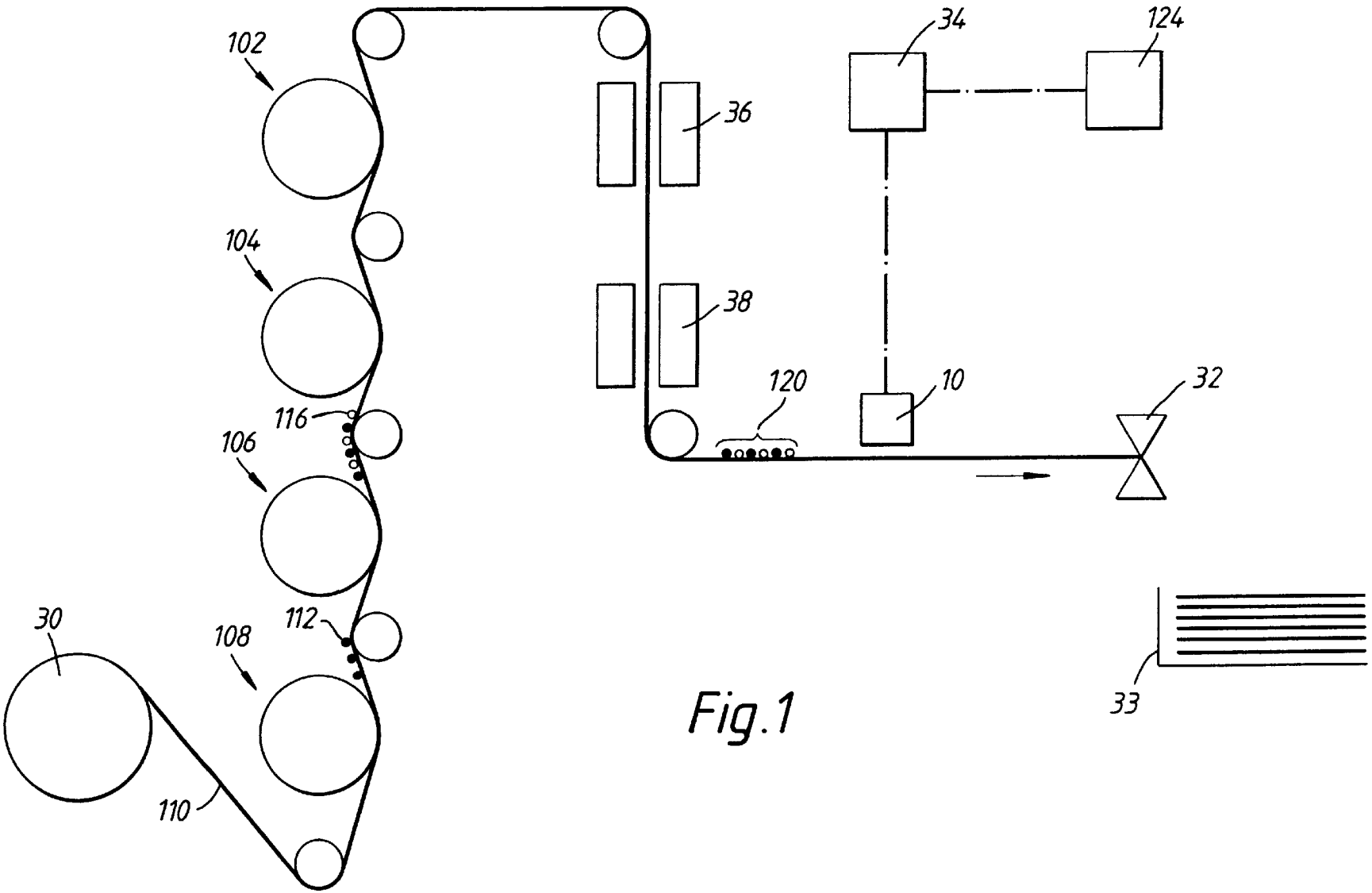
FIG. 1 shows a multi-color printer for use in a method according to the invention.

The predetermined signature $S_O$ is stored in a storage device 124 (FIG. 1) and the comparison between the measured reflectivity signature $S_M$ of the multi-color pattern 120 with the predetermined signature $S_O$ is carried out in a comparison device within the control device 34. The adjustment factor $f_m$ is applied to the printer to ensure correct registration of subsequently printed images. The black printing station 108, is considered as a reference station requiring no adjustment. The adjustment factor $f_m$ is therefore indicative of an adjustment to be applied, in this case, to the magenta printing station 104.

The process is repeated in which a multi-color pattern 120 printed in cyan and black is printed. This pattern is illuminated by the red LED 12*r*, and the reflectivity measured leads to an adjustment factor $f_c$ for the cyan printing station 106.

The process is repeated in which a multi-color pattern 120 printed in yellow and black is printed. This pattern is illuminated by the blue LED 12*b*, and the reflectivity measured leads to an adjustment factor $f_y$ for the yellow printing station 102.

The reflectometer examines the multi-color pattern 120 with a resolution equal to the size of each group 119$^1$, 119$^2$, etc.

EXAMPLE

In an example, the reflectivity of a composite pattern comprising eleven groups of marks printed in black and magenta were examined by illuminating the composite pattern with green light and was found to be as follows:

| GROUP No. | D = (1/reflectivity) |
|---|---|
| 1 | 1.19 |
| 2 | 1.79 |
| 3 | 2.14 |
| 4 | 1.57 |
| 5 | 1.11 |
| 6 | 0.61 |
| 7 | 0.57 |
| 8 | 0.59 |
| 9 | 0.75 |
| 10 | 1.06 |
| 11 | 1.95 |

These measurements indicate a minimum reflectivity occurs at Group No. 3 (D=2.14). If by prior calibration this position is found to give accurate registration then Group No. 3 represents the point of minimum reflectivity for the predetermined reflectivity signature. A subsequently examined multi-color pattern having a minimum reflectivity at another group, the difference in group numbers indicates the necessary adjustment factor to be applied to the magenta printing station, each Group Number difference requiring an adjustment by a distance Δ.

DEFINITIONS

As used herein, the following definitions apply:

Resolution: The minimum possible registration correction. In electronic printers, the resolution in the transport direction is the clock frequency.

Mark: A single color printed figure, at least two sides of which are orthogonal to the direction of registration correction. The mark and its adjacent space together have a maximum width which is less than the aperture of the sensor. The width of the mark in relation to the resolution determines the detection range. A mark width of "n" times the resolution leads to a detection range of 2n+1.

Period: The combination of one mark and its adjacent space.

Group: Several periods of equally spaced marks. The dimension of a group must be larger than the aperture of the sensor.

Composite group: Two or more superimposed groups.

Pattern: A set of equally spaced groups of marks having a known spacial and density distribution, Composite pattern: Two or more superimposed patterns.

Signature Both the spacial and reflectivity distribution of a composite pattern.

I claim:

1. In a printer in which at least two printing stations cause images to be printed on a substrate, said printer being capable of registration adjustment, method for monitoring registration of images printed thereby, the method comprising:

(a) printing a pattern of spaced black registration marks onto said substrate by operation of one of said printing stations;

(b) printing a pattern of spaced non-black registration marks onto said substrate by operation of a second of said printing stations, said pattern of spaced non-black registration marks being superimposed on said pattern of spaced black registration marks to form a composite pattern of registration marks and interposed spaces;

(c) illuminating said composite pattern with at least one LED having an output wavelength complementary to said non-black color;

(d) examining the reflectivity of said composite pattern at wavelengths complementary to said non-black color to obtain a reflectivity signature for said composite pattern; and (e) comparing said reflectivity signature to a predetermined reflectivity signature for said composite pattern, indicative of good registration, to determine an adjustment factor for said printer.

2. The method according to claim 1, further comprising applying said adjustment factor to said printer to ensure correct registration of subsequently printed images.

3. The method according to claim 1, wherein said pattern of spaced black registration marks comprises a first sequence of first marks having a known spacial distribution; and said pattern of spaced non-black registration marks comprises a second sequence of second marks having a spacial distribution different from that of said first sequence.

4. The method according to claim 1, wherein: said pattern of spaced black registration marks comprises a sequence of equally spaced groups of first marks having a first spacing, and said pattern of spaced non-black registration marks comprises a sequence of equally spaced groups of second marks having a second spacing, said first spacing being different from said second spacing.

5. The method according to claim 4, wherein: said printer has a minimum possible registration adjustment which can be applied thereto, and said first spacing and said second spacing have a difference which corresponds to said minimum possible registration adjustment.

6. The method according to claim 1, wherein said predetermined reflectivity signature includes a point of minimum reflectivity and said measured reflectivity signature includes a point of minimum reflectivity, offset from the position of said predetermined reflectivity signature minimum by a distance indicative of said adjustment factor.

7. The method according to claim 1 further comprising the step of measuring the reflectivity of said composite pattern by allowing light from said light emitting diodes to be reflected by said composite pattern to fall on a light sensor, without the imposition of color filters.

8. The method according to claim 1, wherein:

said step of printing said pattern of black registration marks comprises spacing said pattern of black registration marks substantially along the transport direction of said substrate; and said step of printing said pattern of non-black registration marks comprises spacing said pattern of non-black registration marks substantially along the transport direction of said substrate.

9. An apparatus for monitoring registration of multiple color images in a printing device having a plurality of color printing stations, the apparatus comprising:

(a) a first of said printing stations for printing a pattern of spaced black registration marks onto a substrate;

(b) a second of said printing stations for printing a pattern of spaced non-black registration marks onto said substrate, said pattern of spaced non-black registration marks being superimposed on said pattern of spaced black registration marks to form a composite pattern of registration marks and interposed spaces;

(c) at least one light-emitting diode (LED) having an output wavelength complementary to said non-black color for illuminating said composite pattern;

(d) a sensor for measuring the reflectivity of said composite pattern at wavelengths complementary to said non-black color to obtain a reflectivity signature for said composite pattern; and (e) a control device coupled to said sensor and printing stations for comparing said reflectivity signature to a pre-determined reflectivity signature for said composite pattern, indicative of good registration, and for providing a corresponding adjustment factor to said printer.

10. The apparatus according to claim 8 further comprising a storage device coupled to said control device for providing said pre-determined reflectivity signature.

* * * * *